United States Patent [19]

Nagel

[11] Patent Number: 4,619,425

[45] Date of Patent: Oct. 28, 1986

[54] PULSE CODE SYSTEM FOR RAILROAD TRACK CIRCUITS

[75] Inventor: Harry C. Nagel, Murrysville, Pa.

[73] Assignee: American Standard Inc., New York, N.Y.

[21] Appl. No.: 284,150

[22] Filed: Jul. 17, 1981

[51] Int. Cl.[4] ..... B61L 21/00

[52] U.S. Cl. ..... 246/34 R; 246/34 B; 246/167 R; 371/25

[58] Field of Search ..... 246/34 R, 34 CT, 34 B, 246/63 R, 63 A, 63 C, 28 R, 121, 167 R, 187 B, 187 R; 371/71, 24, 25

[56] References Cited

U.S. PATENT DOCUMENTS

| | | | |
|---|---|---|---|
| 3,543,236 | 11/1970 | Sibley | 246/63 R |
| 4,161,718 | 7/1979 | Cohen et al. | 371/71 |
| 4,320,881 | 3/1982 | Campbell | 246/34 R |

*Primary Examiner*—James J. Groody
*Attorney, Agent, or Firm*—A. G. Williamson, Jr.

[57] ABSTRACT

An alternating current code, alternately transmitted in each direction through the rails of a railroad track section, includes a selected number of pulses of alternately positive and negative polarity similar to a bi-polar DC code. Data is transmitted by pulse length, with long and short pulses representing binary digits 1 and 0, respectively. The code pattern, polarity and pulse length, is balanced to eliminate code distortion by track energy storage. The code pattern transmitted is determined, and received pulses are decoded, by a microprocessor with associated memory (PROM) which processes local input and output data. The processor also checks the operation of the associated apparatus, including input and output circuit and hardware integrity through monitor devices and feedback signals. A unique check signal output is produced only when the various monitor networks determine all operation is proper and that the various elements are free of faults. The generation of operating energy for the associated apparatus by a power supply unit is dependent upon its continued reception of this check signal from the processor. Absence of the check signal indicating apparatus fault or operational failure shuts down the system operation at that location.

14 Claims, 4 Drawing Figures

PULSE CODE SYSTEM FOR RAILROAD TRACK CIRCUITS

BACKGROUND OF THE INVENTION

My invention pertains to a pulse code system for transmitting data through the rails of a railroad track section. More particularly, the invention pertains to a unique pulse code system for transmitting, through the rails included in a railroad track circuit, data including both information and commands in addition to the functions of train detection and movement control.

Pulse codes, for example of an on/off direct current energy type with rates below 7 Hz, have long been used in track circuits in railroad signaling systems. These DC coded track circuits detect the presence or absence of trains within the circuit and transmit indications of advance traffic conditions which control the signals governing the train movements. The length of such track circuits may be as much as 15,000 feet which is a distinct advantage in high speed signaling systems. Such track circuits have been highly successful even though they transmit a limited amount or scope of information. One problem which has been solved over the years is that of the energy storage effect in the rails which is equivalent to a resistor-capacitor series network across the rails tending to prolong the on-time, that is, the energy on periods, of the code. Such track circuits are normally provided with a resistor shunt to quickly drain this charge from the rails during each energy off period. On occasion, a modulated alternating current may be used as the rail current, that is, the code pulses are of alternating current of a selected frequency. Such pulses may be used to control cab signals carried on the trains in addition to control of the wayside signals. Such alternating current coded track circuits are of shorter weight because of the high rail attenuation to the alternating current. It is desirable, of course, to replace the coding and decoding relays with solid state devices. However, direct substitution into the DC coded track circuit of such devices creates interfacing problems because of the track storage characteristic. Isolation between the rails and the solid state devices is also required to provide transient protection and noise reduction. Solutions to overcome the energy storage problem are possible but are complicated by the necessity for using an added means to shunt the rails during the off periods of the code pulses. The possible alternative is a bi-polar code similar to a DC pulse code but including a plurality of pulses in each code transmission. In other words, each code group includes a selected number of pulses so that the track energy storage effect is substantially eliminated within each code transmission. The result is a low frequency alternating current so that transformer coupling to the rails from the wayside apparatus is possible. This solves the interface and isolation requirements and makes it possible to transmit an increased amount of data through the rails of the track circuit.

Accordingly, an object of my invention is an improved pulse code system for transmitting data through the rails of a railroad track section.

Another object of the invention is pulse code apparatus for transmitting data through the rails of a railroad track using a code format which eliminates the track storage energy factor.

Also an object of my invention is a pulse code system which transmits data through the rails of a track circuit by a bi-polar code having a selected number of pulses with the pulse length designating the character of each pulse.

A further object of the invention is a pulse code system for transmitting information through the rails of a railroad track with a low frequency alternating current which is effectively a bi-polar direct current code with a predetermined number of pulses in each group with selected length characteristics to determine the data transmitted.

It is also an object of my invention to provide a code system for a railroad track section in which a bi-polar pulse code is used to transmit information through the rails with individual pulses having selected length characteristics to create a pattern which eliminates track energy storage distortion.

Yet another object of the invention is apparatus to transmit data in either direction through the rails of a railroad track section in which the operation of the power supply at each location to supply operating energy to the apparatus is dependent on the reception from the central data processor unit of a check signal indicating the correct operation of all elements of the system.

A still further object of my invention is a pulse code system for a railroad track section in which a low frequency alternating current in the form of bi-polar code pulses is alternately transmitted from each end, successive pulses in each code group being of opposite polarity and having selected lengths, long or short, to form a pattern which designates the data transmitted, a central processing unit at each location decoding the received pulses to register the data and checking the correct operation of each system element, this processing unit also providing a check signal, which maintains the apparatus power supply active to provide operating energy, only when correct operation of the total system is assured.

Other objects, features, and advantages of the invention will become apparent from the following specification and appended claims when taken in connection with the accompanying drawings.

SUMMARY OF THE INVENTION

According to the invention, a solid state code transmitter and receiver device is located at each end of a railroad track section to alternately transmit data codes through the rails to be received by the other end receiver element. Each code is a low frequency alternating current but with a wave form of a bi-polar direct current code that consists of a selected number of code pulses. Because of the alternating current characteristics of the code, the transmitter/receiver may be transformer coupled to the rails which isolates the solid state devices from the rail transients and provides an interface element. The pulses of this code are alternately of opposite polarity and each pulse is of a selected length, that is, long or short, to establish a code pattern which designates specific information being transmitted. The code formats are also preselected, that is, the combination of pulse lengths and opposite polarities, so that the capacitor storage effect of the rails is effectively balanced out during each code transmission. In each transmitted code, the first and last steps are synchronizing pulses which are always of relative positive polarity and have a short character. In one specific pattern which is illustrated, nine pulses are included in each code pattern with the inner seven being used to transmit the actual desired data. However, to maintain a balance of the positive and negative energy during each code, not all of the possible combinations of the seven pulses are used.

At each wayside location where adjacent track sections are adjoining, a single central data processor unit (CPU) provides control and/or data processing for the pair of associated transmitter/receivers which are connected one to each track circuit, that is, to the rails of the corresponding track section. The CPU correlates the local conditions and establishes the pulse code transmitted in each direction through the rails. Each processor unit also decodes the received pulses to register the data received from the other end of the corresponding track section. Preferably, this processing unit is a microprocessor device of solid state design such as are well known in the art. It incorporates, or associates with, the necessary memory such as programmable read only memory (PROM) devices which are considered as included in the specific showing. The CPU also receives inputs from local devices which detect train presence and traffic conditions and record other data which is to be reported. Some of the data may be received through the adjacent track section for retransmission to a central control point. Received data is registered in solid state relays and is used to control traffic and perform other functions.

The processor unit also monitors the operation of the output register relays, the input signals from the wayside logic and detectors, and other functions through the use of monitor devices and feedback signals. When these operational checks and monitoring determine that the system operation is proper and/or agrees and compares with that which is expected, the CPU generates a signal having a predetermined special characteristic. When this signal is then applied to the local power supply, it generates energy for the operation of the system apparatus at that location. The operation of this power supply element is dependent on the continued reception of the special signal from the processor and its absence inhibits the operation. This shuts down system operation at that location when an indication of improper operation or failure of any of the system elements is indicated and assures vitality of the system operation.

BRIEF DESCRIPTION OF THE DRAWINGS

Before defining my invention in the appended claims, I shall describe in more specific detail a preferred arrangement of the pulse code system for track circuits embodying the invention, as illustrated in the accompanying drawings in which:

In each of the drawings, the same or similar parts of the apparatus are designated by the same or similar reference characters.

SPECIFIC DESCRIPTION OF THE ILLUSTRATED EMBODIMENT

Figure 1:
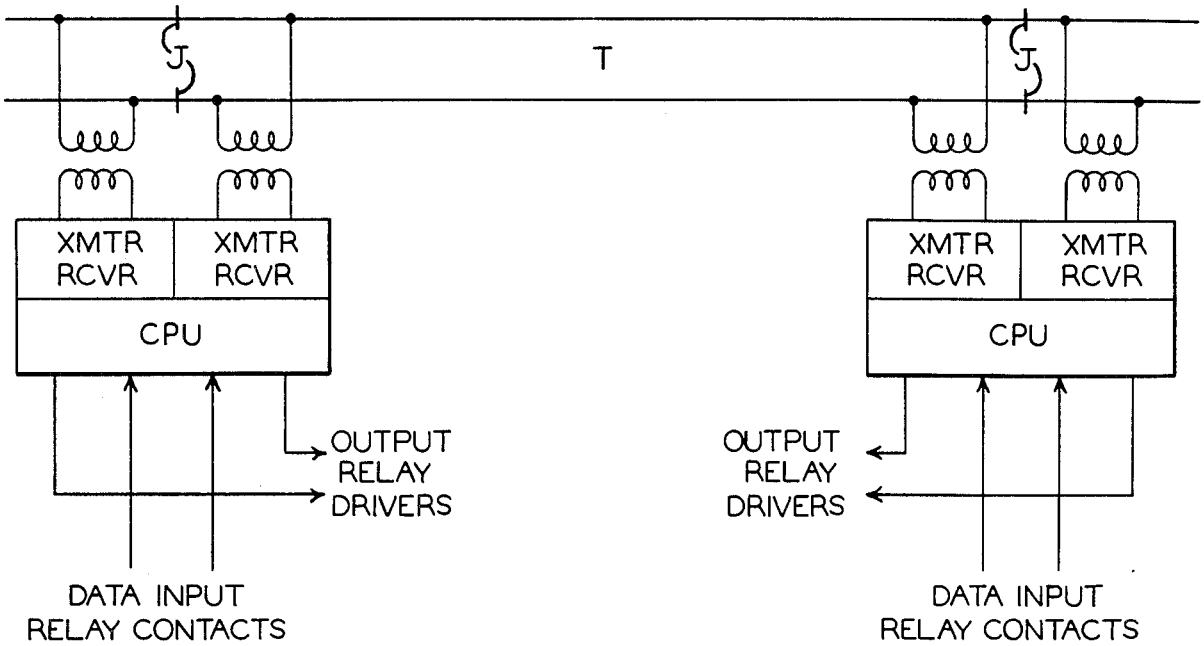
FIG. 1 is a schematic illustration of a pulse code system applied at the opposite ends of one section of railroad track.

Referring to FIG. 1, across the top is illustrated a stretch of railroad track with each rail represented by a conventional single line symbol. The track is divided into insulated track sections, for example, the section T shown in its entirity and bounded at left and right by the conventionally shown insulated joints J. At each end of section T, a code transmitter/receiver device is coupled to the rails by an isolation transformer shown by a conventional symbol. The transmitter/receiver is illustrated by a conventional block, designated XMTR-RCVR, since the particular transmitter and receiver circuitry is not critical to the understanding of the invention. At each location, a similar transmitter/receiver device is coupled to the rails of the adjacent track section on the opposite side of the insulated joints J. It is to be noted that the transformer winding connections to the rails are reversed on each side of the joints so that, assuming similar polarity in the transformer track windings, the failure of an insulated joint may be detected by the opposing polarities occuring in the same rail.

The pair of transmitter/receiver units at each location are associated with a central data processing unit conventionally shown by the block designated CPU. Preferably the CPU is a solid state microprocessor device, such as are well known in the art, with sufficient memory to function in the pulse code system designed. This memory may be in the form of read only memory (ROM) or programmable read only memory (PROM) units in accordance with the operation or function desired. The pulse code to be transmitted from a location is developed by the CPU and supplied to the XMTR block for transmission through the rails. The code received through the rails from the XMTR at the other end of the section is applied by the RCVR element to the CPU for decoding. The transmitted code is developed in accordance with local input signals coupled into the CPU over relay contacts. The decoded functions or data from the received code are registered in output relays which, in keeping with the system, are solid state devices. The manner of applying the collected data for transmission and the supply of the decoded information to the registry relays is described in more detail shortly.

Figure 2:
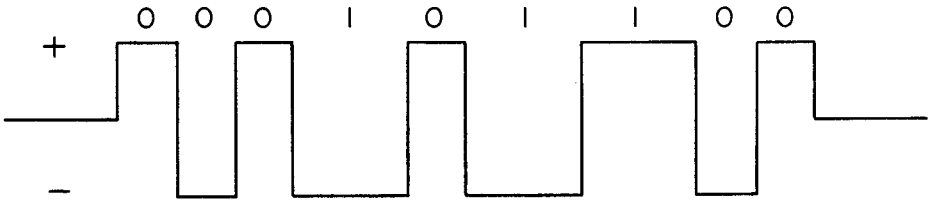
FIG. 2 is a chart illustrating a sample pattern of a code pulse group transmitted through the rails by the apparatus embodying the invention.

FIG. 2 illustrates a typical wave form of a pulse code group including nine pulses or steps which are of alternately positive and negative polarity. The polarity signifies that which appears on a selected rail in the section, for example, the upper rail of section T in FIG. 1 and the lower rail in each adjoining section. The patterns of pulse code groups of the invention are not restricted entirely to those including nine steps but such length is used in one specific system. An odd number of steps is preferable in order to obtain an unequal number of pulses of the two polarities to enable each track section to have a polarity opposite to that of an adjacent track section. As shown in FIG. 2, a long pulse is considered to represent a binary digit 1 while the short pulse represents the other digit 0. The first and last pulses of each pattern always have a positive polarity and a short character to serve as guard or synchronizing pulses. This feature, together with the odd number of pulses, also provides for detection of insulated joint failure since normally the adjacent section has a positive polarity on the other rail during these guard steps. In addition, code patterns used are so selected that the positive and negative energy substantially balances and thus the problem of track energy storage is eliminated so that no distortion occurs. The use of the odd number of pulses and balanced energy levels substantially avoids residual direct current in the coupling transformers.

Although the code appears to be patterned after a conventional DC track code, with bi-polar characteristics, it is actually an alternating current with bi-polar pulses with a maximum length for each nine step code pattern of less than 500 milliseconds, as an example from one installation. The pulses are kept relatively short in the overall time periods and a very short period of time is provided after each pulse group is transmitted to allow the apparatus at the receiver location to decode before transmitting a response.

The message or data transmitted is in accordance with a combination of long and short pulses of either polarity of the seven inner pulses, i.e., excluding the first and last guard pulses. Because the positive and negative energy must be balanced to avoid track energy storage distortion, not all possible long/short combinations of the seven pulses can be used. As will appear in other figures, input data or information to be transmitted is translated from a normal five bit form by the CPU in accordance with a predetermined tabulation into selected balanced long/short combinations of seven pulses which are then transmitted. Decoding is accomplished in the reverse direction by the CPU from received seven pulse codes into corresponding five bit outputs.

Figure 3:
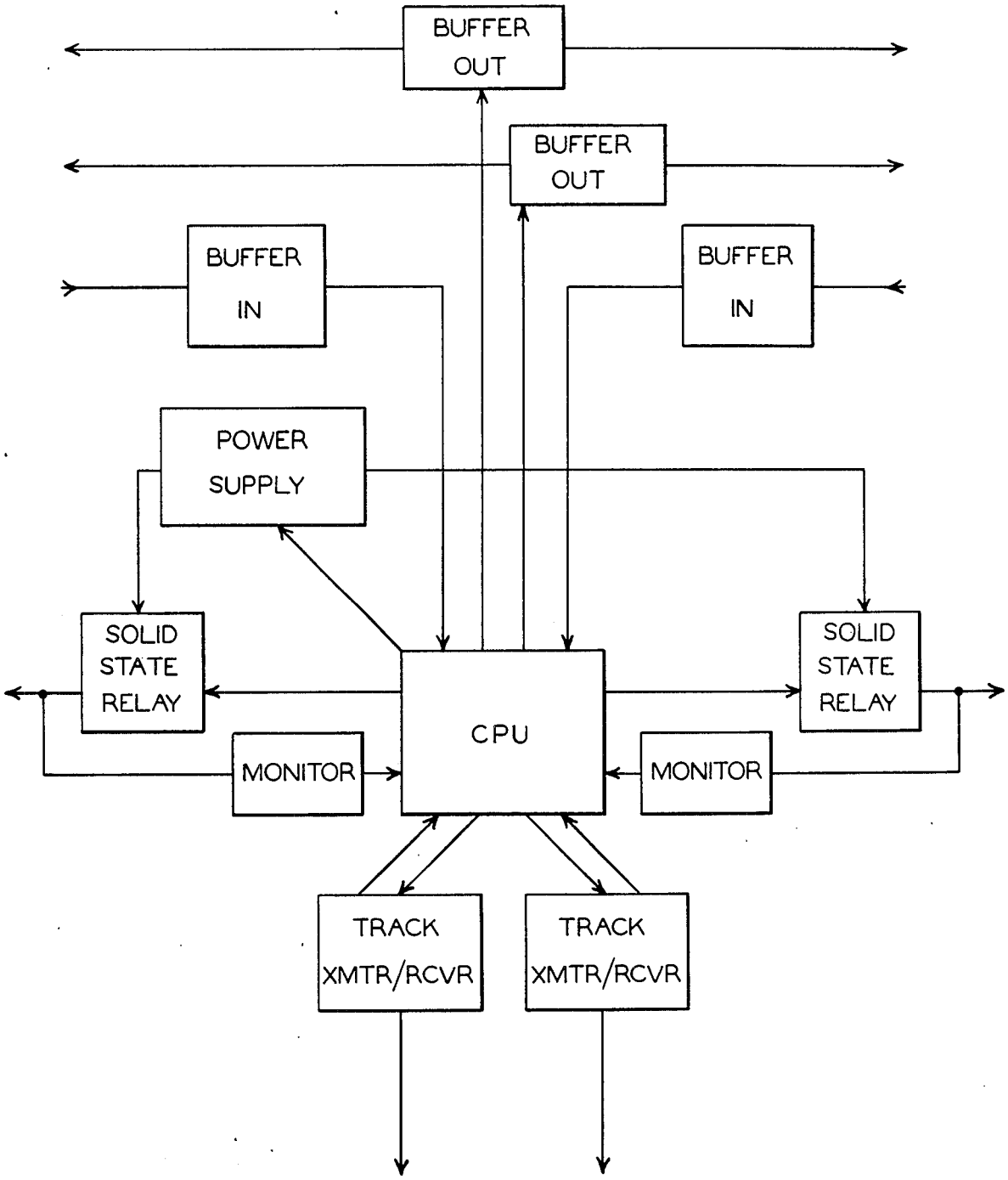
FIG. 3 is a schematic block diagram showing in conventional form and greater detail apparatus at one wayside location in the system of FIG. 1.

FIG. 3 is a block diagram and flow chart of the basic elements in the operation at one wayside location. The principal element is the processor CPU which, as previously mentioned, is preferably a microprocessor with the necessary associated PROM units. At the bottom of the drawing conventional blocks designate the transmitter and receiver units, one set for each adjoining track section to correspond with the arrangements shown in FIG. 1. The general inputs and outputs for the CPU are channeled through buffer elements, for example, amplifiers, to isolate the local apparatus from the processor. There is an input network, of course, from each track section while the indicated outputs which include certain common check procedures, are supplied for either section. The CPU also controls solid state output relay devices to register the received codes. Although only one is shown for each section, in practice there are normally five output relays for each section. A power supply unit, shown by conventional block, provides operating energy especially for the output relays.

It is to be noted that the operation of each relay and its output are monitored and reported back to the CPU. This monitoring network represents a vital check system to assure the correct operation of the arrangement. The processor is responsive to these feedback or check signals, if all are received in proper condition and characteristic, to produce a special signal which is applied as indicated to the power supply unit. This latter unit remains operational to supply operating energy only when the special signal is actively received. In other words, the absence of this signal shuts down the power supply so that the apparatus at this wayside location lacks operating energy and operation ceases. This condition will continue until the fault or improper operation is corrected.

Figure 4:
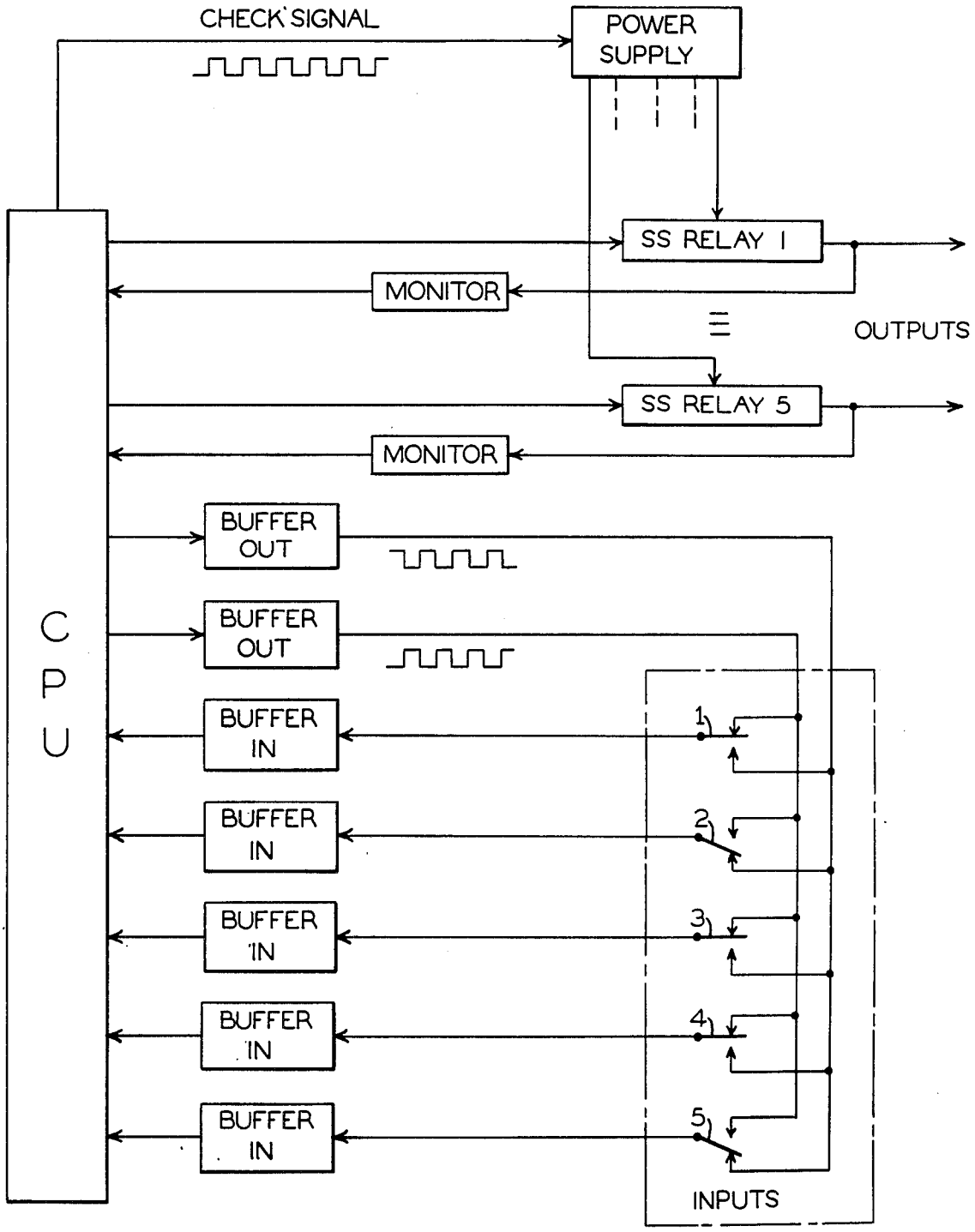
FIG. 4 is a schematic flow diagram illustrating the checking arrangement for vitally checking the operation of the apparatus associated with one end of a track section or track circuit.

An expanded version of the vital check arrangement is shown in FIG. 4, although still using conventional blocks and flow chart layout. This arrangement includes only one half of the network associated with the processor unit at a location, that is, the checking network related only to one of the adjacent track sections. The solid state relays shown in the upper right are controlled by the CPU in accordance with the received code. Only two of the five relays are specifically illustrated, each being the same and having similar connections to the processor. The output and operation of each relay is monitored and a signal returned to the CPU through a monitor buffering device as long as proper operation of the relay is detected. Each monitoring network is dynamically tested on a periodic basis to assure proper operation and integrity of not only the output relay but also the monitor device and circuits.

To assure proper operation of the inputs to the CPU from the external local relay logic, additional monitor checks are provided to assure the integrity of the external wiring and relay contacts shown at the lower right. To provide a dynamic check of the input devices, two periodic signals are produced by the processor, each of the same frequency but exactly 180° out of phase with each other, as conventionally represented by the two square waveform symbols adjacent the parallel output channels from the CPU. These signals are amplified by the two output buffer devices shown, the lower buffer providing the complementary waveform to the upper one. As shown, the upper buffer is connected in multiple to all the external input relay back contacts and the lower buffer is connected in multiple to all the external input relay front contacts. Then as long as each input relay remains in either its energized or deenergized position and the input wiring remains intact, each buffer input device, which is individually connected to the respective external input relay heel contact, will have an AC waveform to buffer into the processor. In this manner, the processor will receive either the signal produced by the upper output buffer or its complement as produced by the lower output buffer at all times through each of its input buffers. The processor can establish whether the external relay is energized or deenergized by the phase of the signal received from each input buffer. The five sets of input contacts 1 to 5 shown in the lower right represent the respective states of five external logic relays which have been energized or deenergized by the conditions of associated equipment in accordance with various field conditions. The processor will receive the signal as amplified by the lower output buffer over input contacts 1, 3, and 4 and the signal as amplified by the upper output buffer over input contacts 2 and 5 and thus correctly interpret that corresponding relays 1, 3, and 4 are energized and relays 2 and 5 are deenergized. The CPU then selects, in accordance with the preset tabulation, the corresponding combination of seven code pulses for transmission.

If the CPU receives all proper monitor signals, it generates a check signal output to the power supply as shown at the upper part of the figure. This signal is illustrated conventionally as a square wave signal but, for example, in one installation is a signal having a frequency of 500 Hz. The power supply or generator shown in the upper right may specifically be a DC to DC converter to generate operating energy of a regulated nature for the solid state relays. Operation of this supply is dependent on the continued reception of the check signal, that is, the 500 Hz signal from the CPU. If no check signal is received, the power supply operation ceases and all the output relays move to their deenergized condition since no operating energy is provided. This shuts down the pulse code system apparatus at this location, which is a vital check, until any fault may be determined and corrected.

The arrangement of the invention thus provides an effective and efficient pulse code system using solid state elements for transmitting data through the rails of a track section. Codes are alternately transmitted in each direction carrying such data as train detection, advanced traffic conditions, and other information pertinent to train operation or control. Each code is actually an alternating current but with a wave form equivalent to a bi-polar DC pattern. This eliminates distortion due to track storage effect, that is, the opposite polarities cancel the usual track storage, and allows a track circuit length equivalent to that obtainable with the single polarity DC code known in the art. Checks and feedbacks into the control processor provide a vital check of the proper operation of the apparatus. Operation of the power supply which provides energy at least for the operation of the output relays is dependent on the continued reception of a special check signal from the processor unit. This signal is produced only as long as the vital monitoring operation indicates correct operation by and absence of faults in the apparatus. Detection of apparatus faults or improper operation, e.g., absence of any signal on an input buffer, shuts down the system until correction is accomplished.

Although I have herein shown and described but one arrangement embodying the track circuit pulse code system of my invention, it is to be understood that various changes and modifications therein may be made, within the scope of the appended claims, without departing from the spirit and scope of my invention.

Having thus described the invention what I claim as new and desire to secure by Letters Patent, is:

1. A pulse code system for transmitting in each direction through the rails of a section of railroad track data representing wayside conditions and controls associated with that section, comprising, (a) transmitter/receiver means coupled to the rails at each end of said section for transmitting and receiving through said rails an alternating current code having selected pulse characteristics, (b) a data processor means coupled to each transmitter/receiver means for selecting, in accordance with applied input data, the pulse characteristics of each code transmitted through the rails to the receiver at the other end of said section and for decoding the data carried by the code pulses received through the rails from the transmitter at said other end, (c) an input network coupled to each processor means for supplying wayside input data for transmission to said other end, (d) an output means coupled to each data processor means for outputting the data decoded from received code pulses, (e) a power supply means coupled to each output means for providing operating energy, (f) a first monitor network controlled by each data processor means and coupled for dynamically checking the operation of the associated output means and responsive for supplying monitor signals to said processor means when correct operation of the associated output means and said first monitor network is detected, (g) a second monitor network jointly controlled by each data processor means and associated input network and coupled for checking the integrity of the associated input network and completeness of the input data supplied, (h) each data processor means responsive to monitor signals from the associated first monitor network and to the integrity check of the associated second monitor network for generating a check signal, and (i) each power supply means coupled to the associated processor means for receiving said check signal and enabled for providing operating energy to the associated output means only when said check signal is present.

2. A pulse code system as defined in claim 1 in which, (a) each alternating current code comprises a selected number of successive bi-polar code pulses having predetermined individual length characteristics to form a unique pattern designating the transmitted code, and (b) each bi-polar code pattern is selected to balance the energy of the two polarities applied to the section rails to substantially eliminate track energy storage effects.

3. A pulse code system as defined in claim 2 in which, (a) said output means comprises a plurality of output relays, one for each element of the decoded output data, (b) said first monitor network is coupled for supplying to said processor means feedback signals representing the condition of each output relay in response to current output data, and (c) said processor means is responsive for registering the correct condition of said output relays and the integrity of said first monitor network when said feedback signals are equivalent to the current output data.

4. A pulse code system as defined in claim 3 in which, (a) each input network includes a plurality of two position switching contacts, each registering in its first and second positions the first or second condition of one element of input data, and which further includes, (b) an output network controlled by each processor means for generating a pair of complementary alternating current monitoring signals and coupled for supplying one signal to associated first position switching contacts and the complement signal to associated second position switching contacts, (c) each switching contact coupled to the corresponding processor means for supplying said one or said complement monitoring signal in accordance with the existing registered condition of the corresponding element of input data, (d) each processor means is responsive to the monitor signal input for selecting the pulse characteristics of the transmitted code and for determining the integrity of the associated input and second monitoring networks, and (e) processor means is further responsive for generating said check signal for said power supply means only when correct monitor signals are received from the associated first and second monitor networks.

5. A pulse code system as defined in claim 4 in which, (a) said check signal is an alternating current signal having a predetermined frequency substantially higher than the frequency of the code pulses, and (b) each associated power supply means is enabled for providing operating energy to the associated output relays only when the alternating current check signal of said predetermined higher frequency is present.

6. A pulse code system as defined in claim 5 in which, (a) each output relay is a solid state type relay, and (b) each first monitor network is coupled to the output signal of each associated output relay for checking the condition of that relay.

7. In a pulse code data transmission system for a stretch of railroad track, at each location common to adjacent insulated track sections into which said stretch is divided, the combination comprising, (a) a pair of transmitter/receiver means, one coupled to the rails of each section for transmitting or receiving a selected pulse code through the rails between that location and the other end of the corresponding section, (b) processor means coupled to both transmitter/-receiver means for selecting the codes to be transmitted through the rails in accordance with input data applied for each section and for decoding the data included in the codes received from the other end of each section, (c) an input network for each section coupled to said processor means for applying input data designating condition and controls in the corresponding section, (d) an output means coupled to said processor means for separately outputting the decoded data received by each receiver means, (e) a power supply means coupled for normally providing operating energy for said output means, (f) a first monitor network controlled by said processor means and coupled for dynamically checking the operation of said output means by comparing the output data with the corresponding received code, (g) a second monitor network controlled by said processor means and coupled for checking the integrity of each input network to assure transmission of correct input data for each section, (h) said processor means responsive to the operation of said first and second monitor networks for generating a check signal only when the operation of said output means checks proper without fault and the integrity of both input networks is assured, and (i) said power supply means is further controlled by said processor means and is responsive for providing operating energy to said output means only when said check signal is generated.

8. A pulse code system as defined in claim 7 in which, (a) each pulse code is an alternating current with square wave half cycles, and (b) each data code includes a preselected number of half-cycles having selected individual lengths to establish the code pattern designating the data being transmitted.

9. A pulse code system as defined in claim 7 in which, (a) each pulse code comprises a preselected number of successive bi-polar pulses individually having selected lengths to form a code pattern designating the data transmitted, and (b) each code pattern further selected for balancing the energy of the two polarities applied to the rails to substantially eliminate track energy storage in the rails.

10. A pulse code system as defined in claims 8 or 9 in which, each pulse in a code has a first or a second selected length to establish the pattern designating the data being transmitted.

11. A pulse code system as defined in claim 10 in which, (a) said output means includes a plurality of relays for each receiver means, one relay for each element of the corresponding decoded data received by the associated receiver means, (b) said first monitor network coupled for supplying said processor means with feedback signals representing the condition of each output relay in response to current output data from the corresponding receiver means, and (c) said processor means responsive for registering the correct conditions of each plurality of output relays and the integrity of said first monitor network when each plurality of feedback signals is equivalent to the corresponding decoded data.

12. A pulse code system as defined in claim 11 in which, (a) each input network includes a plurality of two position switching contacts, each registering in its first and second position the first or second condition, respectively, of one element of the corresponding input data, and which further includes, (b) an output network controlled by said processor means for generating a pair of complementary alternating current monitoring signals and coupled for supplying one signal to each first position contact and the complement signal to each second position contact of both pluralities of switching contacts, (c) each switching contact coupled for supplying said one or said complement monitoring signal to said processor means in accordance with its current position to apply the current registered condition of the corresponding input data element, (d) said processor means responsive to the monitoring signals input from each plurality of switching contacts for selecting the pulse characteristics of the corresponding transmitted code and for determining the integrity of the associated input network and second monitor network, and (e) said processor means further responsive for generating said check signal for said power supply means only when the correct condition of each output relay, the integrity of each input network, and the integrity of all monitor networks have been determined.

13. A pulse code system as defined in claim 12 in which, (a) said check signal is an alternating current signal of a preselected frequency substantially higher than the code pulse frequency, and (b) said power supply means is enabled for providing operating energy to said output relays only when said alternating current signal of said higher preselected frequency is present.

14. A pulse code system as defined in claim 13 in which, (a) each output relay is a solid state type relay, and (b) said first monitor network is coupled to the output of each output relay for checking the condition of that relay.

* * * * *